United States Patent [19]

Foster

[11] 4,361,250

[45] Nov. 30, 1982

[54] PLASTIC CONTAINER CLOSURE

[75] Inventor: John A. Foster, Rockford, Ill.

[73] Assignee: J. L. Clark Manufacturing Co., Rockford, Ill.

[21] Appl. No.: 277,931

[22] Filed: Jun. 26, 1981

[51] Int. Cl.[3] ..... B65D 41/32

[52] U.S. Cl. ..... 220/266; 220/254; 220/339; 220/307; 222/153; 222/541

[58] Field of Search ..... 220/254, 266, 307, 339, 220/270; 222/153, 541

[56] References Cited

U.S. PATENT DOCUMENTS

| | | | |
|---|---|---|---|
| 3,095,995 | 7/1963 | Foster | 220/60 |
| 3,251,509 | 5/1966 | Foster | 222/153 |
| 3,255,928 | 6/1966 | Foster | 222/153 |
| 3,370,757 | 2/1968 | Foster | 222/153 |
| 3,675,812 | 7/1972 | Foster | 220/31 S |
| 3,872,996 | 3/1975 | Dogliotti | 220/254 |
| 4,059,201 | 11/1977 | Foster | 220/258 |
| 4,106,672 | 8/1978 | Tecco et al. | 220/339 X |

*Primary Examiner*—George T. Hall

*Attorney, Agent, or Firm*—Leydig, Voit, Osann, Mayer & Holt, Ltd.

[57] ABSTRACT

The hinged flap of a plastic container closure is molded while in an open position and, during molding of the flap, hinged strips with depending pins are formed along the sides of the flap and are integrally connected with the flap by tearable webs. After the flap has first been closed, the pins are anchored to the top of the closure and prevent the flap from opening during shipment of the container. Initial opening of the flap is effected by swinging the flap upwardly with a substantial force to tear the webs and separate the webs from the strips and the anchor pins, the torn webs providing a visual indication that the flap has been opened.

7 Claims, 6 Drawing Figures

PLASTIC CONTAINER CLOSURE

BACKGROUND OF THE INVENTION

This invention relates to a plastic container closure of the type in which a flap is integrally hinged to the top panel of the closure and is adapted to be swung upwardly and downwardly to open and close a dispensing opening which is formed through the top panel. More particularly, the invention relates to a closure of the type in which a recess is formed in the top panel around the dispensing opening with the recess receiving the flap when the flap is in its closed position so that the upper surface of the flap may lie flush with the upper surface of the top panel. A container closure of this general type is disclosed in Foster U.S. Pat. No. 3,675,812. Such a closure is molded while the flap is in an open position.

SUMMARY OF THE INVENTION

The general aim of the present invention is to provide a new and improved closure of the foregoing type in which unique means hold the flap securely in its closed position until the container is first opened and, at the same time, provide a visual indication as to whether the container has been tampered with and opened prior to purchase by the consumer.

A more detailed object is to achieve the foregoing by providing a closure in which the flap is initially held in its closed position by a pin which is anchored to the top panel after the closure has been molded and which is connected to the flap by a tearable web. Before the flap is initially swung upwardly, the pin and the web coact to hold the flap closed and to prevent accidental opening of the flap during shipment of the container. When a substantial manual lifting force is applied to the flap, the web tears and permits the flap to swing open, the torn web providing visual evidence that the original seal is no longer intact.

A further object of the invention is to provide a closure in which a pair of hold-down pins and a pair of tearable webs are uniquely molded with the flap while the latter is in an open position and in which the pins are secured to the top panel after the flap has first been closed.

The invention also resides in the provision of novel plastic strips which connect the hold-down pins to the tearable webs and which, together with the flap, substantially fill the recess in the top panel of the closure when the flap is closed.

These and other objects and advantages of the invention will become more appatent from the following detailed description when taken in conjunction with the accompanying drawings.

DETAILED DESCRIPTION OF THE PREFERRED EMBODIMENT

Figure 1:
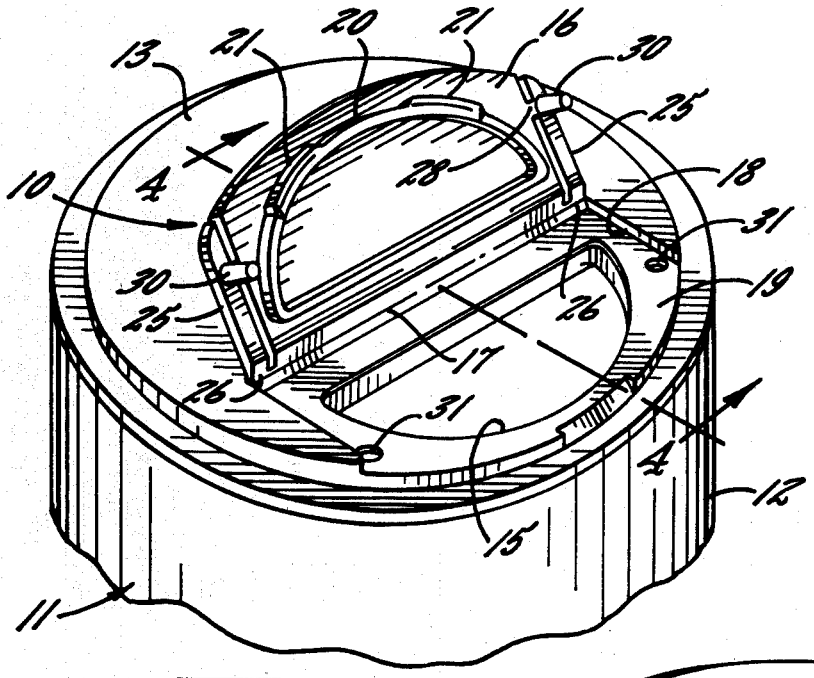
FIG. 1 is a fragmentary perspective view of a container equipped with a new and improved closure incorporating the unique features of the present invention and shows the flap after the flap has been molded and before the flap has been first closed.

As shown in the drawings for purposes of illustration, the invention is embodied in a closure 10 for a container 11 adapted to hold a food product such as bread crumbs or the like. The container is of conventional construction and includes a cylindrical body 12 made of paperboard and having an open upper end.

Figures 4, 5, 6:
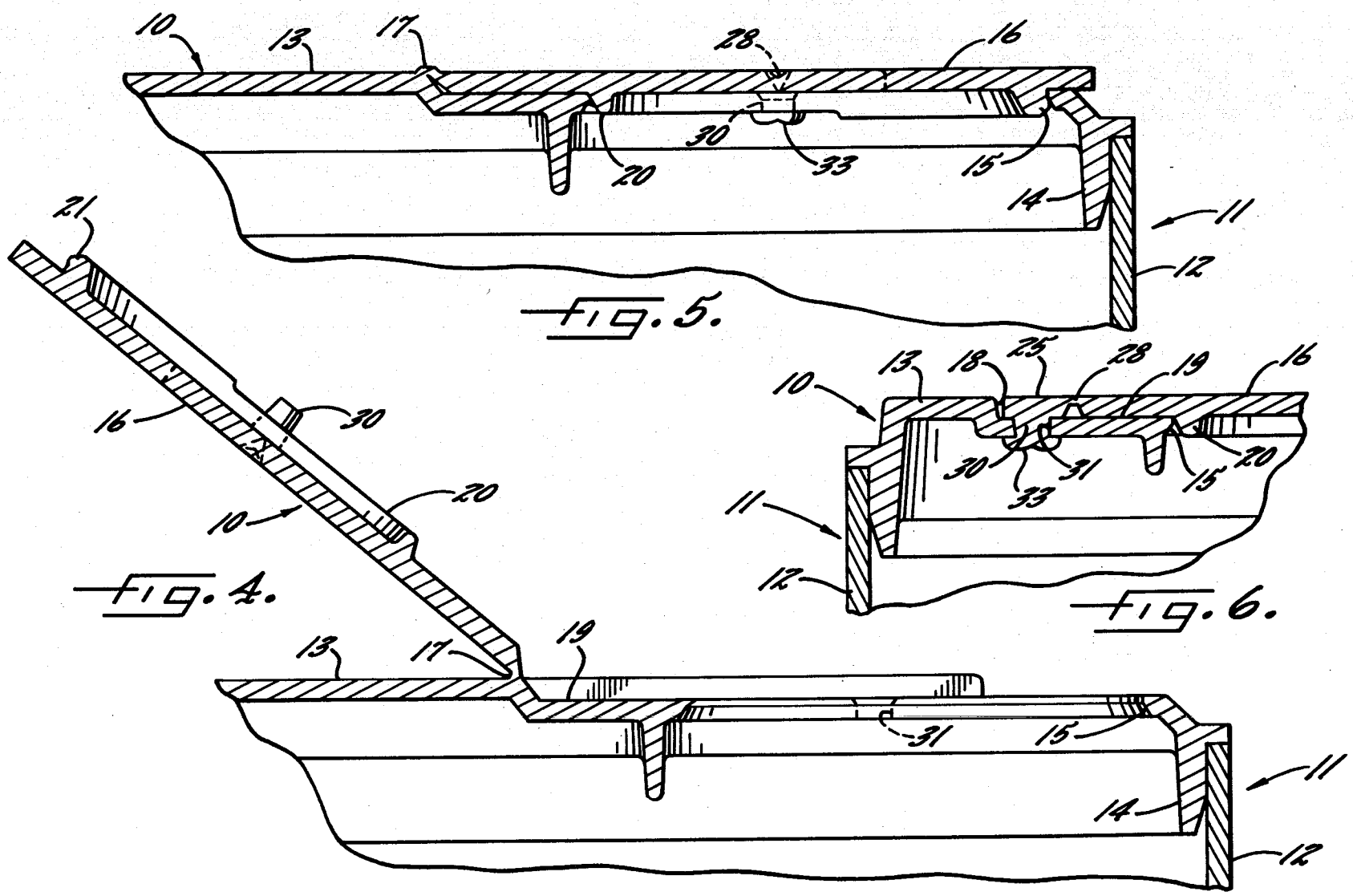
FIG. 4 is an enlarged fragmentary cross-section taken substantially along the line 4—4 of FIG. 1.
FIGS. 5 and 6 are enlarged fragmentary cross-sections taken substantially along the lines 5—5 and 6—6, respectively, of FIG. 2.

The closure 10 comprises a cover defined by a generally horizontal top panel 13 of circular shape and molded from suitable plastic. A skirt 14 (FIG. 5) is molded integrally with and depends from the top panel adjacent the periphery thereof and is telescoped snugly into the upper end portion of the container body 12.

Formed through the top panel is a dispensing opening 15 (FIG. 1) which may be of any desired shape. Also, two or more adjacent dispensing openings may be provided in place of the single opening 15 which has been shown. The upper side of the dispensing opening 15 is adapted to be closed by a flap 16 molded integrally with the top panel 13 and swingably connected to the top panel by a hinge 17. The hinge is formed by molding a weakened section in the plastic along the junction between the top panel and the flap.

An upwardly opening recess 18 (FIG. 1) is formed around the opening 15 and in the upper side of the top panel 13 to receive the flap 16 and thus enable the upper side of the flap to be located flush with the upper side of the top panel when the flap is in its closed position. The recess 18 is similar in shape to the flap and its bottom defines an upwardly facing platform 19 upon which the flap rests when the flap is closed. A depending rib 20 having the same shape as the opening 15 is molded integrally with the underside of the flap and is adapted to telescope into and seal the opening when the flap is swung to its closed position. Short lugs 21 are molded integrally with part of the rib and engage the edge of the opening 15 with a releasable snap fit to hold the flap in its closed position while permitting the flap to swing upwardly when a slight upward force is exerted on the flap. The flap is molded while in an upright or slightly inclined position (see FIG. 1) as disclosed substantially in Foster U.S. Pat. No. 3,675,812 and is first closed after the closure 10 has been ejected from the molding dies.

In accordance with the present invention, unique means are provided for augmenting the hold-down action of the lugs 21 and for securely locking the flap 16 downwardly in its closed position between the time the flap is first closed after molding and the time the flap is first opened by a purchaser of the container 11 so as to prevent the flap from accidentally popping open during shipment of the container. Moreover, the locking means also provide the consumer with a visual indication as to whether the container has been tampered with and the flap opened prior to the purchase.

More specifically, the aforementioned means herein comprise a pair of plastic pieces 25 located at opposite side edges of the flap 16. Each plastic piece preferably is in the form of an elongated strip which extends along the adjacent side edge of the flap and is spaced laterally therefrom by a short distance. The inner ends of the strips 25 are located adjacent opposite ends of the hinge 17 and are hinged to the top panel 13 at 26. The hinge 17 and the hinges 26 are defined by a single continuous straight weakened section in the top panel 13.

Figure 2:
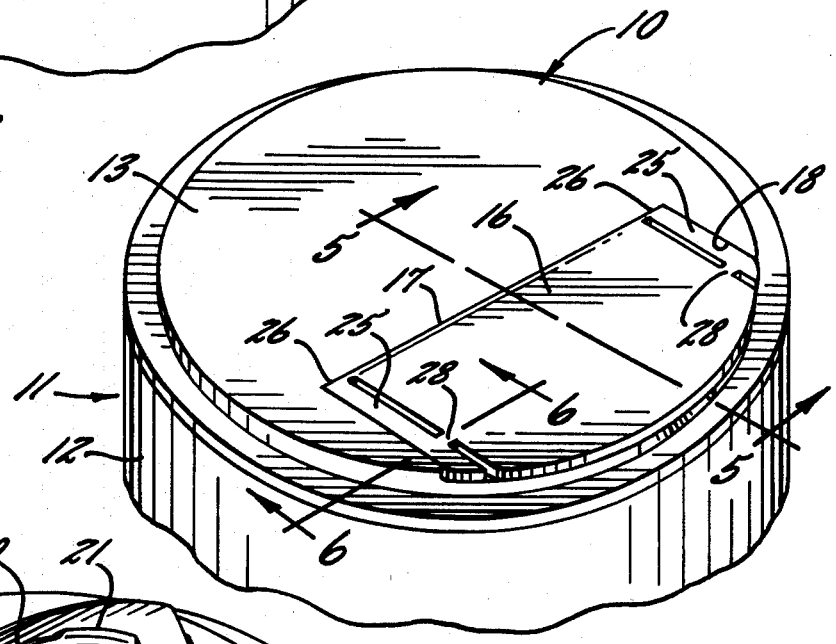
FIG. 2 is a perspective view similar to FIG. 1 but shows the flap after the flap has been first closed and before the flap has been initially opened.

In carrying out the invention, a thin tearable web 28 (FIGS. 2 and 6) of plastic interconnects each strip 25 with the adjacent side edge of the flap 16. The webs 28 are located near the outer end portions of the strips 25 and are formed integrally with the strips and the flap when the flap is molded in its open position (see FIG. 1). By virtue of the webs 28, the strips 25 swing downwardly with the flap 16 when the latter is first closed after being molded.

To hold the flap 16 securely in its closed position during shipment, a downwardly projecting pin 30 (FIG. 1 and FIGS. 4 to 6) is molded integrally with the underside of each strip 25 alongside the web 28. The pins are molded while the flap is in its open position shown in FIG. 1. When the closure 10 is ejected from the molding dies and the flap is subsequently swung downwardly, the pins move downwardly through vertical holes 31 (FIG. 1) formed through the platform 19. Thereafter, the lower ends of the pins are subjected to a heat staking operation to form enlargements 33 (FIGS. 5 and 6) on the lower ends of the pins and prevent the pins from being pulled upwardly out of the holes 31.

Accordingly, the strips 25, the webs 28 and the pins 30 all are molded integrally with the flap 16 while the latter is in its open position. When the flap is closed, the strips 25 move downwardly into the recess 18 with the flap and coact with the flap to fill up the recess and leave the top of the closure 10 substantially flat (see FIG. 2).

As a result of the enlargements 33 which are formed on the pins 30 after initial closure of the flap 16, the strips 25 are positively locked downwardly against the platform 19 and are prevented from hinging upwardly. Because the flap 16 is connected to the strips 25 by the webs 28, the flap also is held downwardly and is prevented from flying open during shipment of the container 11 even if the container is subjected to such rough handling as would effect release of the lugs 21. Thus, there is no danger of the contents of the container escaping from the dispensing opening 15 until such time as the closure 10 is intentionally opened by the consumer.

Figure 3:
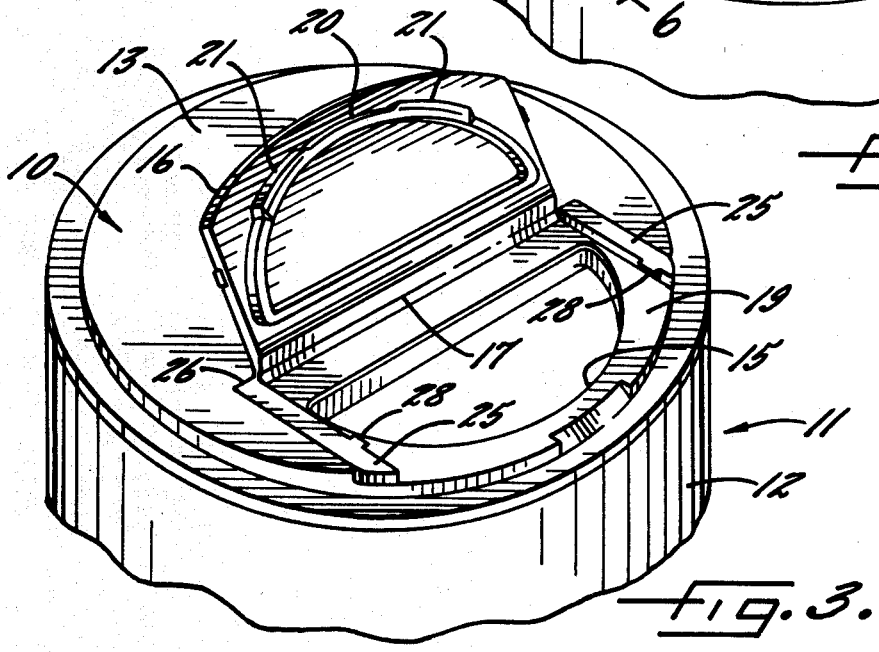
FIG. 3 is also a perspective view similar to FIG. 1 but shows the flap after the flap has been initially opened.

To open the closure 10, the consumer applies a substantial upward lifting force to the free edge of the flap 16 with a thumb or a finger. Such force is effective to tear the small webs 28 and enable the flap 16 to separate from the strips 25. As a result, the flap may be swung upwardly to its open position while the strips remain locked against the platform 19 by virtue of the pins 30 (see FIG. 3). After initial opening, the flap may be swung to its closed position and will be held releasably in that position by the lugs 21. Subsequent opening of the flap may be effected in an easy manner since the force required to release the lugs 21 is significantly less than the force required to tear the webs 28.

In addition to holding the flap 16 down during shipment, the webs 28 indicate to the consumer whether the container 11 has been opened prior to the time the container has been purchased by the consumer. Upon seeing torn webs 28 on the closure 10, the consumer is notified that the container has been previously opened and thus is warned against purchasing that particular container. Thus, the webs 28 provide the closure 10 with a tamperproof feature.

Those familiar with the art will appreciate that the holes 31 could be formed through the strips 25 while upwardly projecting pins 30 could be molded integrally with the platform 19. After the flap 16 has been molded and closed, the upper ends of the pins may be heat staked to hold the strips down and to prevent opening of the flap until such time as the webs 28 are torn.

I claim:

1. A container closure comprising a top panel molded of plastic, a dispensing opening formed through said top panel, a flap molded integrally with and hinged to said panel and swingable upwardly and downwardly relative thereto between open and closed positions with respect to said dispensing opening, an upright hole formed through said panel, an upright plastic pin extending through said hole, means integral with the lower end of said pin and preventing said pin from being pulled upwardly out of said hole, and a tearable web molded integrally with said flap and joined to said pin, said web coacting with said pin to initially hold said flap in said closed position and then tearing when said flap is initially swung upwardly thereby to permit said flap to move to said open position.

2. A container closure comprising a top panel molded of plastic, an upwardly opening recess formed in the upper side of said top panel and defining a platform which is spaced below the upper side of the top panel, a dispensing opening formed through said platform, a flap, a hinge molded integrally with said flap and said top panel and mounting said flap for upward and downward swinging between open and closed positions, said flap exposing said opening when in said open position and being disposed within said recess and covering said opening when in said closed position, a plastic piece located within said recess alongside said flap, an upright hole formed through said platform and underlying said plastic piece, a pin molded integrally with and depending from said plastic piece and extending downwardly through said hole, means integral with the lower end of said pin and preventing said pin from being pulled upwardly out of said hole, and a tearable web molded integrally with said flap and said plastic piece, said web coacting with said plastic piece and said pin to initially hold said flap securely in said closed position and then tearing when said flap is swung upwardly thereby to permit said flap to separate from said plastic piece and move to said open position.

3. A container closure as defined in claim 2 in which said plastic piece comprises a strip extending along and spaced laterally from one side edge of said flap and having an inner end hinged integrally to said top panel at one end of said hinge.

4. A container closure comprising a top panel molded of plastic, an upwardly opening recess formed in the upper side of said top panel and defining a platform which is spaced below the upper side of the top panel, a dispensing opening formed through said platform, a flap, a hinge molded integrally with said flap and said top panel and mounting said flap for upward and downward swinging between open and closed positions, said flap exposing said opening when in said open position and being disposed within said recess and covering said opening when in said closed position, a pair of plastic strips extending along and spaced laterally from opposite side edges of said flaps and having inner ends hinged integrally to said top panel at opposite ends of said hinge, said strips being disposed in said recess, a pair of upright holes formed through said platform and underlying said strips, pins formed integrally with and depending from said strips and extending downwardly through said holes, means integral with the lower ends of said pins and preventing said pins from being pulled upwardly out of said holes, and tearable webs molded integrally with said strips and with opposite sides edges of said flap, said webs coacting with said strips and said pins to initially hold said flap securely in said closed position and then tearing when said flap is initially swung upwardly thereby to permit said flap to separate from said strips and move to said open position.

5. A container closure as defined in claim 4 in which said means comprise enlargements which are formed on the lower ends of said pins by heat staking the lower ends of said pins after said flap has initially been swung to said closed position and said pins have been projected through said holes.

6. A container closure as defined in claim 4 in which said recess is substantially filled by said flap and said strips when said flap is in said closed position.

7. A container closure comprising a top panel piece molded of plastic, a dispensing opening formed through said panel piece, a flap molded integrally with and hinged to said panel piece and swingable upwardly and downwardly relative thereto between open and closed positions with respect to said dispensing opening, a plastic piece located alongside said flap, an upright hole formed through one of said pieces, an upright plastic pin integral with the other of said pieces and extending through said hole, means on the free end of said pin and preventing said pin from being pulled out of said hole, and a tearable web molded integrally with said flap and said plastic piece, said web coacting with said plastic piece and said pin to initially hold said flap in said closed position and then tearing when said flap is initially swung upwardly thereby to permit said flap to move to said open position.

* * * * *